US005720581A

United States Patent [19]

Bacon et al.

[11] Patent Number: 5,720,581

[45] Date of Patent: Feb. 24, 1998

[54] SUPPORT PROP

[75] Inventors: Michael S. Bacon, Midrand; Andrew T. Greenwood, Northmead; Ivan Terblanche, RichardsBay; Allan W. Hillier, Sasolburg; Anthony J.S. Spearing, Randburg, all of South Africa

[73] Assignee: Dorbyl Limited, Bedfordview, South Africa

[21] Appl. No.: 549,824

[22] PCT Filed: May 5, 1994

[86] PCT No.: PCT/GB94/00961

§ 371 Date: Jun. 26, 1996

§ 102(e) Date: Jun. 26, 1996

[87] PCT Pub. No.: WO94/27029

PCT Pub. Date: Nov. 24, 1994

[30] Foreign Application Priority Data

| | | | |
|---|---|---|---|
| May 7, 1993 | [ZA] | South Africa | 93/3209 |
| Oct. 26, 1993 | [ZA] | South Africa | 93/7954 |
| Oct. 29, 1993 | [ZA] | South Africa | 93/8099 |
| Jan. 18, 1994 | [ZA] | South Africa | 94/0339 |
| Apr. 29, 1994 | [ZA] | South Africa | 94/2942 |
| Apr. 29, 1994 | [ZA] | South Africa | 94/2943 |
| Apr. 29, 1994 | [ZA] | South Africa | 94/2944 |

[51] Int. Cl.[6] ..... E21D 15/50

[52] U.S. Cl. ..... 405/290; 248/354.3; 405/288

[58] Field of Search ..... 405/290, 288, 405/289, 303; 248/354.3, 354.1, 548

[56] References Cited

U.S. PATENT DOCUMENTS

| | | | |
|---|---|---|---|
| 2,621,631 | 12/1952 | Donty | 405/290 X |
| 4,185,940 | 1/1980 | Spies | 405/288 |
| 4,640,650 | 2/1987 | Koppers et al. | 405/290 |
| 5,379,566 | 1/1995 | Schworer | 248/354.31 X |
| 5,400,994 | 3/1995 | Shawwaf et al. | 248/354.3 |

FOREIGN PATENT DOCUMENTS

| | | | |
|---|---|---|---|
| 0 018 448 | 11/1980 | European Pat. Off. . | |
| 1 392 995 | 2/1965 | France . | |
| 1 420 175 | 10/1965 | France . | |
| 1 530 636 | 5/1968 | France . | |
| 521 857 | 3/1931 | Germany . | |
| 971 493 | 3/1953 | Germany . | |
| 924 501 | 3/1955 | Germany . | |
| 11 63 275 | 2/1964 | Germany . | |
| 376 063 | 7/1932 | United Kingdom . | |
| 2114183 | 8/1983 | United Kingdom | 405/290 |

*Primary Examiner*—Dennis L. Taylor

*Attorney, Agent, or Firm*—Kinney & Lange, P.A.

[57] ABSTRACT

The support prop consists of an outer robe (12) with an open flared mouth (14) into which a plunger (16) projects. A deforming ring (18) in use engages the plunger and is initially located within the flared mouth of the outer tube. A chamber (26) is provided within the prop into which fluid under pressure can be introduced through an inlet (28) to the chamber to locate the prop between two surfaces by displacing the plunger relative to the outer tube. A seal (24) is located within the chamber to prevent the fluid from escaping between the plunger and the bore of the outer tube.

16 Claims, 10 Drawing Sheets

SUPPORT PROP

FIELD OF INVENTION

This invention relates to a support prop of the kind which involves a tube and a plunger.

PRIOR ART

Yieldable support props are described in South African patent 90/1985. These support props each consist of an outer tube with a flared mouth which accommodates a metal ring surrounding a plunger. The ring has serrations on its bore which engage the plunger. As a yielding load is applied to the prop, the plunger and the ring move downwardly into the outer tube whilst the outer tube is deformed by the ring.

In order to pre-load such a prior art support prop, a set of hydraulic jacks are positioned between the ring and a clamp removably clamped to the plunger. The jacks are connected to a portable hydraulic pump to cause them to extend and thus to set the prop in place at a predetermined load.

A disadvantage associated with this prior art support prop is that in practice difficulty, is encountered in pre-loading the prop in the manner described. In particular during pre-loading, relative movement between the outer tube and the plunger tends to occur resulting in a loss of the pre-load.

A desirable characteristic of a yieldable prop is that it should quickly reach a point at which it will yield at a substantially constant load. Furthermore the load required to cause the prop to yield must be capable of being predicted with a degree of certainty. If a yieldable prop does not yield at a substantially constant load or if the prop yields at unpredictable loads, the consequences can be catastrophic and loss of life and production may result. The prior art yieldable props have suffered from both these disadvantages.

OBJECTS OF THE INVENTION

It is an object of this invention to provide a support prop which can be preloaded in a manner which at least reduces the disadvantages associated with the prior art. It is a further object of this invention to provide a support prop which will yield with at least a degree of certainty.

SUMMARY OF THE INVENTION

According to the invention a support prop includes:

an outer tube with an open flared mouth;

a plunger which projects into the outer robe through its flared mouth;

deforming means which in use engages the plunger and is initially located within the flared mouth of the outer tube;

a chamber within the prop; and an inlet for introducing fluid under pressure to the chamber to locate the prop between two surfaces by displacing the plunger relative to the outer tube.

The support prop may include a seal to prevent fluid from escaping between the plunger and the bore of the outer tube. The seal is preferably a floating cup seal.

An end cap may be secured to the end of the plunger located within the outer tube. A bearing portion which bears against the bore of the outer tube may be provided to locate the plunger within the outer tube to limit axial misalignment of the plunger relative to the outer tube. The bearing portion may be provided on the end cap of the plunger.

The deforming means may have an inner surface with gripping formations which are harder than the plunger so that the gripping formations can bite into the plunger to engage the plunger. The deforming means may have an outer surface with spaced recesses and outer tube contact zones located between the spaced recesses. The outer tube contact zones may taper from their upper ends towards their lower ends. The bottom end of the deforming means is preferably radiused.

At least pan of the bore of the outer metal tube may be coated with friction reducing means. In addition or alternatively the outer surface of the deforming means may be coated with friction reducing means. The friction reducing means may comprise any one of oil, polytetrafluoroethylene, molybdenum disulphide or graphite.

A pedestal is preferably provided inside the outer tube on which pedestal the plunger can seat when the plunger is fully retracted.

The plunger is preferably a tube.

An aperture may be provided in the sidewall of the outer tube through which aperture fluid can escape from the chamber if the plunger is displaced beyond the aperture in the direction of the flared mouth of the outer tube.

At least one marking may be provided on the outer surface of the plunger to indicate over extension or impending over extension of the plunger.

The inlet may be a male or a female coupling. The coupling may be located partly or wholly within the prop. Protecting means may be provided for protecting the inlet. In one form of the invention the protecting means comprises a handle on the prop which handle is preferably located adjacent to the inlet.

According to another aspect of the invention support prop includes:

an outer tube with an open flared mouth:

a plunger which projects into the outer tube through its flared mouth:

deforming means which in use engages the plunger and is initially located within the flared mouth of the outer tube; and friction reducing means applied to at least part of the bore of the outer tube and/or the outer surface of the deforming means.

According to yet another aspect of the invention a method of installing a support prop having an outer tube with an open flared mouth for deforming means and a plunger which projects into the outer tube through its flared mouth includes the steps of introducing fluid under pressure into a chamber within the support prop to locate the support prop between two surfaces by displacing the plunger relative to the outer tube, and thereafter allowing the fluid to drain from the chamber once the deforming means has engaged the plunger.

DESCRIPTION OF THE DRAWINGS

The invention will now be described by way of a non-limiting example with reference to the accompanying drawings in which.

DETAILED DESCRIPTION OF THE DRAWINGS

Figure 1:
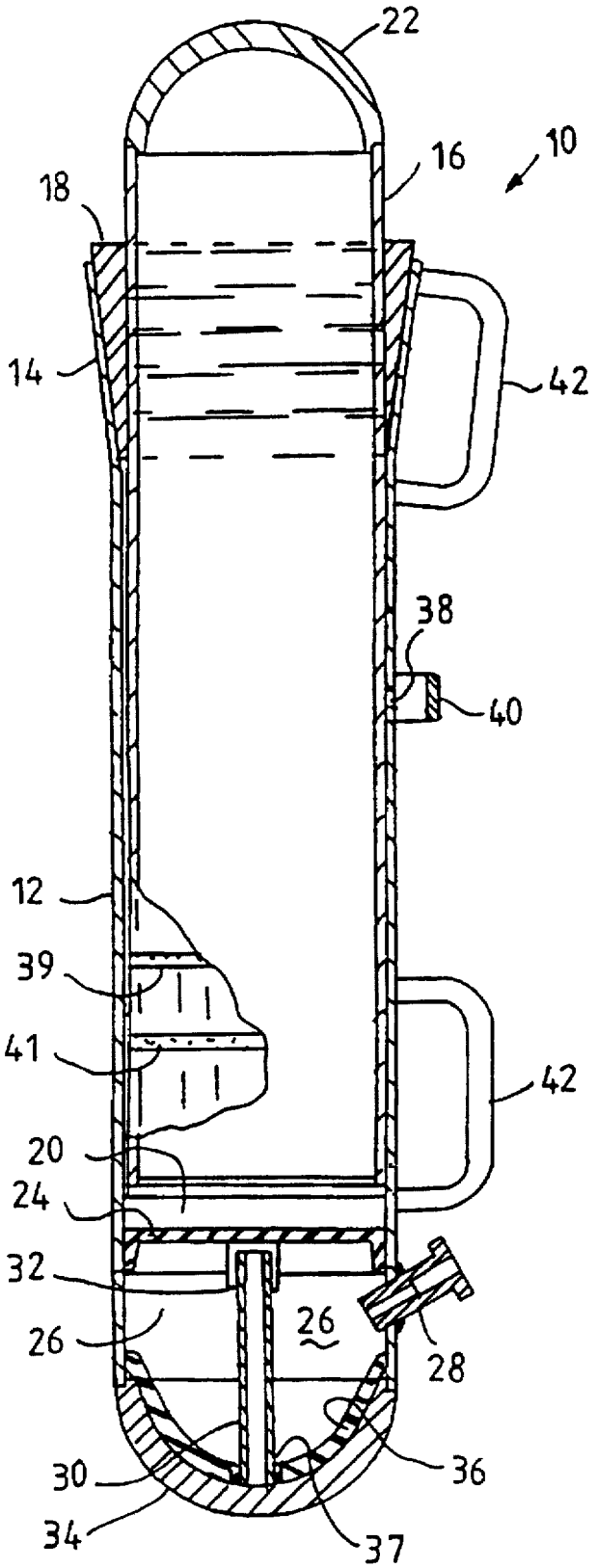
FIG. 1 is a cross-sectional side view of a support prop according to the invention in its fully retracted position.
Figure 2:
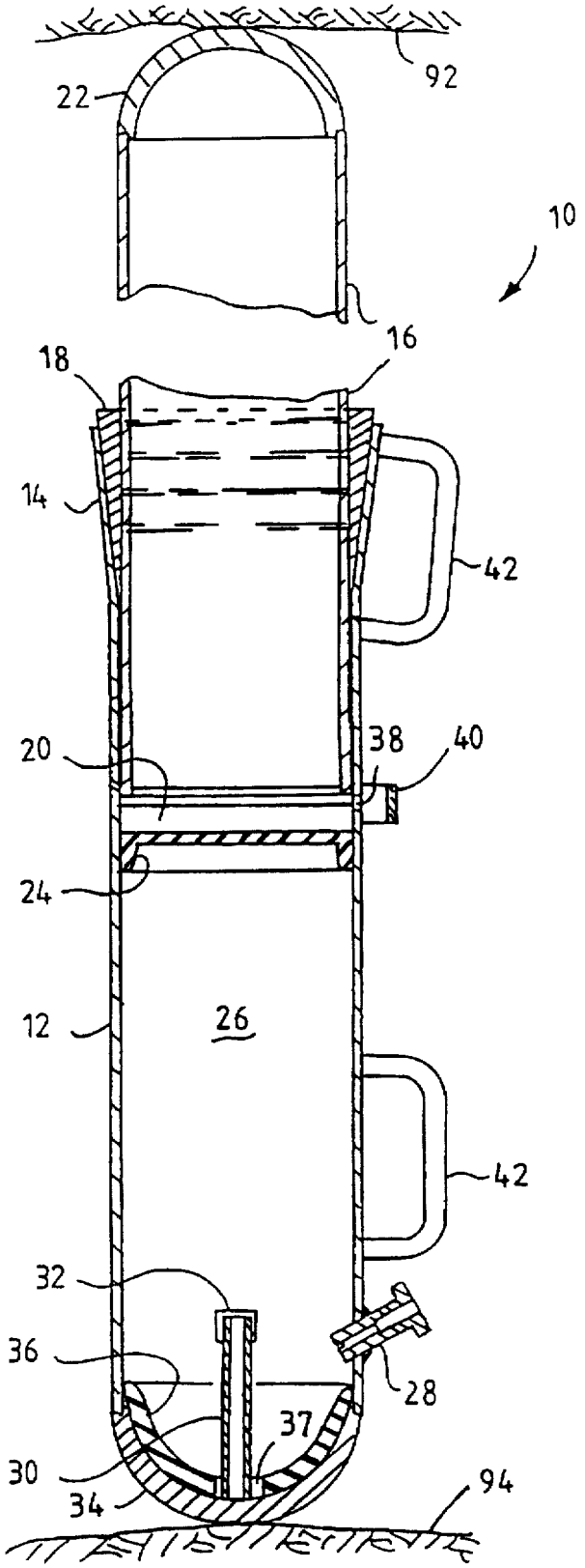
FIG. 2 is a cross-sectional side view of the support prop in its fully extended position.
Figure 3:
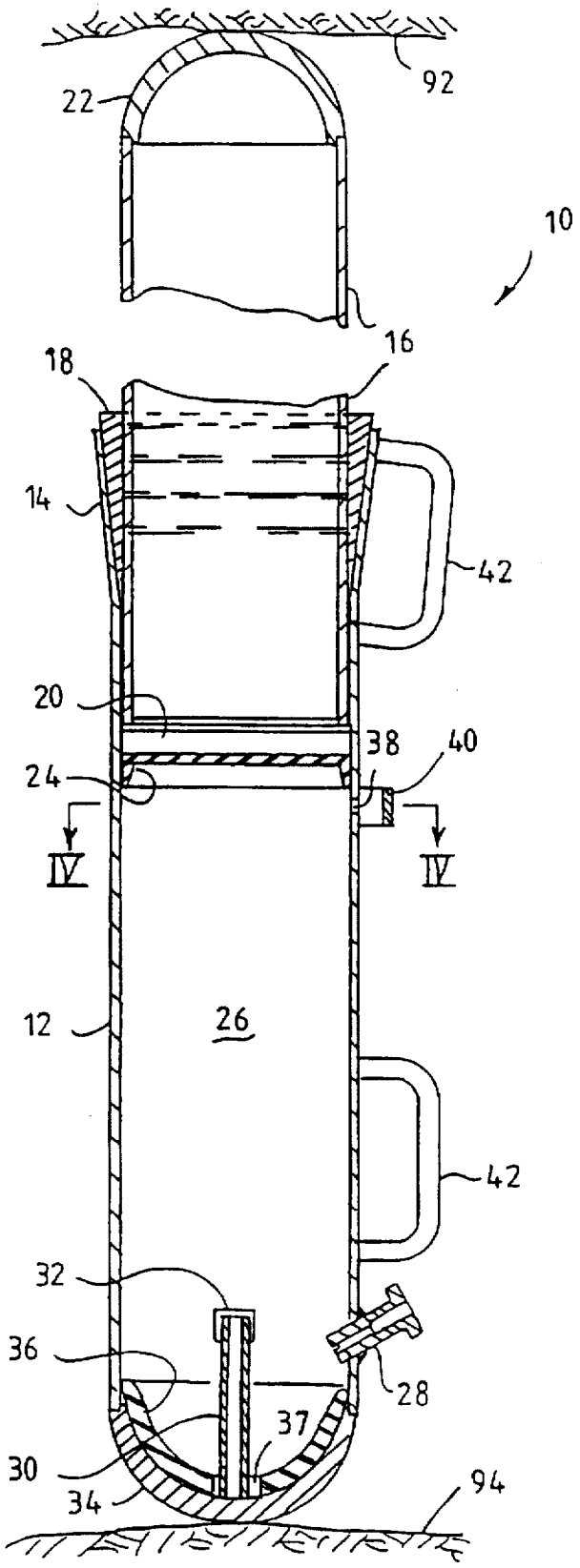
FIG. 3 is a cross-sectional side view of the support prop in an over extended position.
Figure 4:
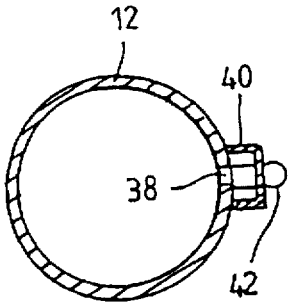
FIG. 4 is a cross-sectional plan view on line IV—IV of FIG. 3.

Referring firstly to FIGS. 1 to 3, a support prop 10 includes a circular cylindrical, outer steel tube 12 with an open flared mouth 14. A plunger 16 in the form of a circular cylindrical steel tube projects into the outer tube 12 through its flared mouth 14. A deforming ring 18 is located within the flared mouth 14.

The plunger 16 has an end cap 20 tack welded to its end located within the outer tube 12 and a domed end 22 tack welded to its opposite end. A floating cup seal 24 abuts the end cap 20. The term "floating" is used herein to refer to a seal which is not attached to the end cap 20.

A pressure chamber 26 is located within the outer tube 12. The cup seal 24 defines the upper limit of the pressure chamber 26 when the plunger 16 is in its fully extended position and when the cup seal 24 abuts the end cap 20. The chamber 26 has an inlet 28.

A pedestal 30 with a plastic cap 32 projects upwardly into the outer tube 12 from a domed end 34 which is a press fit in the outer tube 12. When the plunger is in its fully retracted position as shown in FIG. 1, the cup seal 24 seats on the plastic cap 32 of the pedestal 30. In this position the cup seal 24 does not abut the inwardly projecting portion of the inlet 28. The cup seal 24 is thus protected from damage by this inwardly projecting portion of the inlet 28.

A seal 36 with an aperture 37 through which the pedestal 30 projects is provided on the inside of the domed end 34. The seal 36 seals the junction between the outer tube 12 and the domed end 34. The domed end 34 could equally well be welded by a continuous watertight weld to the outer tube 12 in which case the need for the seal 36 would be obviated.

An aperture 38 is provided in the sidewall of the outer tube 12. A guard 40 in the form of a channel is provided adjacent to the aperture 38. The applicant has found that to limit angular misalignment of the plunger 16 within the outer tube 12, the plunger 16 must have a minimum insertion depth in the outer tube 12 when the prop 10 is at its maximum extension. If the plunger 16 is extended beyond the required minimum insertion depth, the applicant believes that the probability of the prop 10 failing due to buckling will be increased. To prevent the plunger 16 from being extended beyond the required minimum insertion depth, the aperture 38 is provided in the sidewall of the outer tube 12. The aperture 38 will be uncovered when the plunger 16 is extended beyond its minimum insertion depth. Since the diameter of the bore of the aperture 38 is greater than that of the diameter of the bore of the inlet 28, all the water introduced into the pressure chamber 28 will be discharged through the aperture 38. Thus the plunger 16 cannot then be extended any further under the influence of the water.

The outer surface of the plunger 16 has an orange marking 39 in the form of a ring and a red marking 41 in the form of a ring. The markings are positioned on the plunger 16 such that when the orange marking 39 is exposed, it provides a warning that the plunger 16 is about to be extended beyond its minimum insertion depth. If the red marking 41 is exposed the plunger 14 has been extended beyond its minimum insertion depth, and water will be discharged through the aperture 38. The force of a jet of water escaping from the aperture 38 will be dissipated against the guard 40.

Two handles 42 are welded to the outer tube 12 to facilitate handling of the prop 10.

Figure 5:
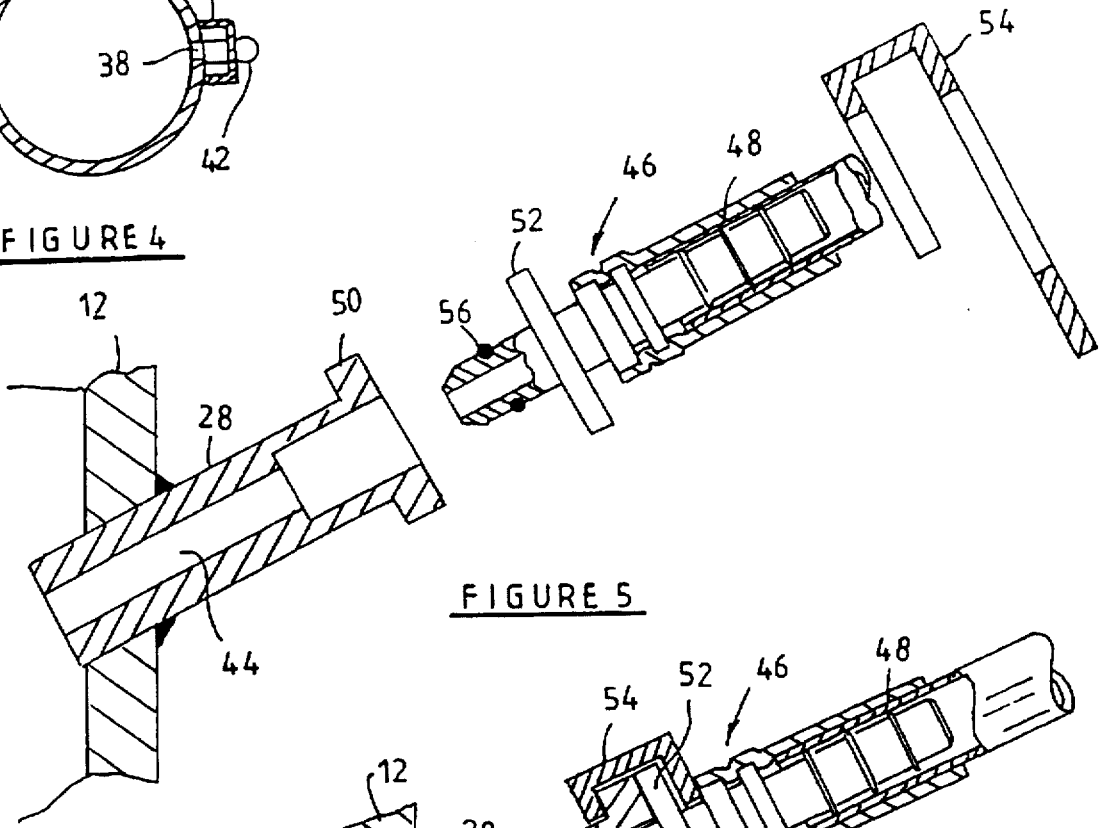
FIG. 5 is an enlarged cross-sectional side view of the inlet with an exploded view of a spigot and locking member.
Figure 6:
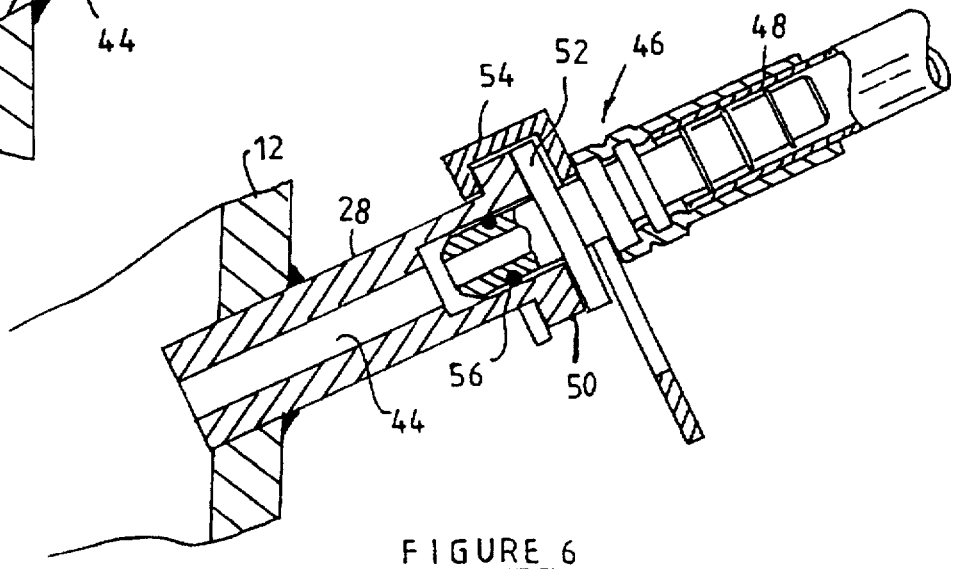
FIG. 6 is the same view as FIG. 5 but with the spigot inserted and locked to the inlet.

Referring now to FIGS. 5 and 6, the axis of the inlet 28 is inclined at 30° to the horizontal to facilitate access to the inlet 28. The diameter of the bore 44 of the inlet is 10 mm. A spigot 46, fastened to a hose pipe 48, can be inserted into the inlet 28. The inlet 28 has a collar 50 as does the spigot 46 which has a collar 52. Once the spigot 46 is inserted into the inlet 28, the spigot 46 is releasably locked to the inlet by a locking member 54 via the collars 50 and 52. An O-ring 56 provides a seal between the spigot 46 and the inlet 28.

Figure 7:
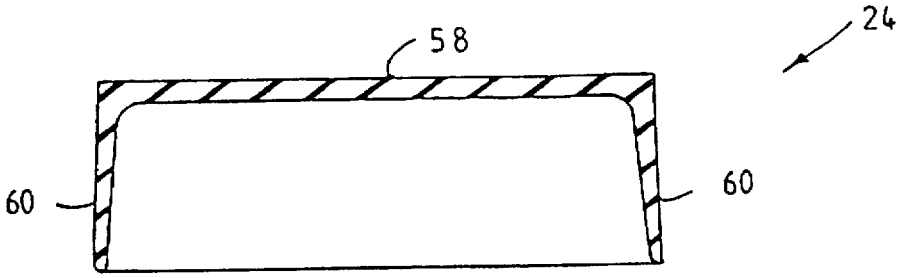
FIG. 7 is a cross-sectional side view of a cup seal.

Referring now to FIG. 7, the cup seal 24 has a base 58 and an outwardly flared, peripherally extending skirt 60. The skirt 60 is at least 25 mm long, and preferably 40 mm long, to prevent it from tilting within the outer tube. The cup seal 24 is made of natural rubber which has a Shore hardness of 70. The cup seal 58 may however be made of nitrile.

Figure 8:
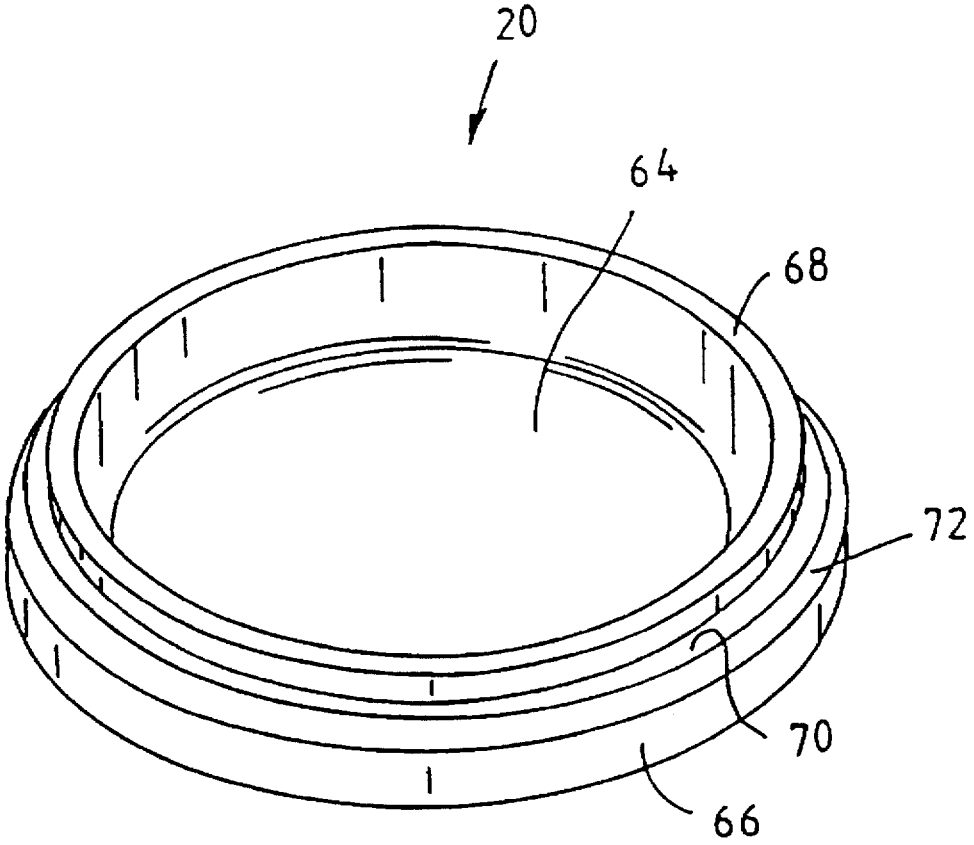
FIG. 8 is a perspective view of an end cap for a plunger of the support prop.
Figure 9:
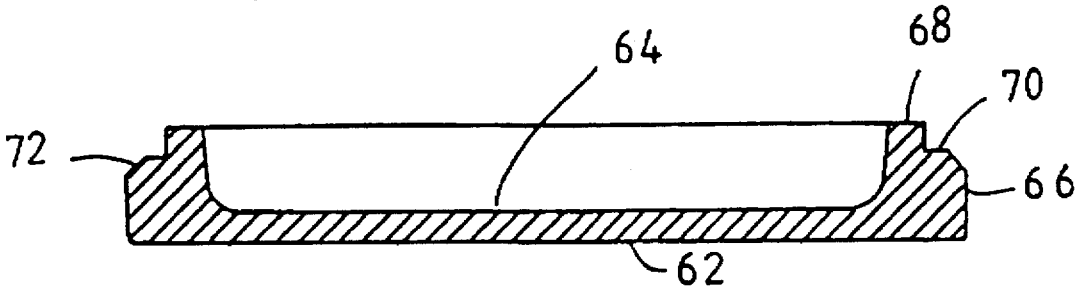
FIG. 9 is a cross-sectional side view of the end cap of FIG. 8.
Figure 10:
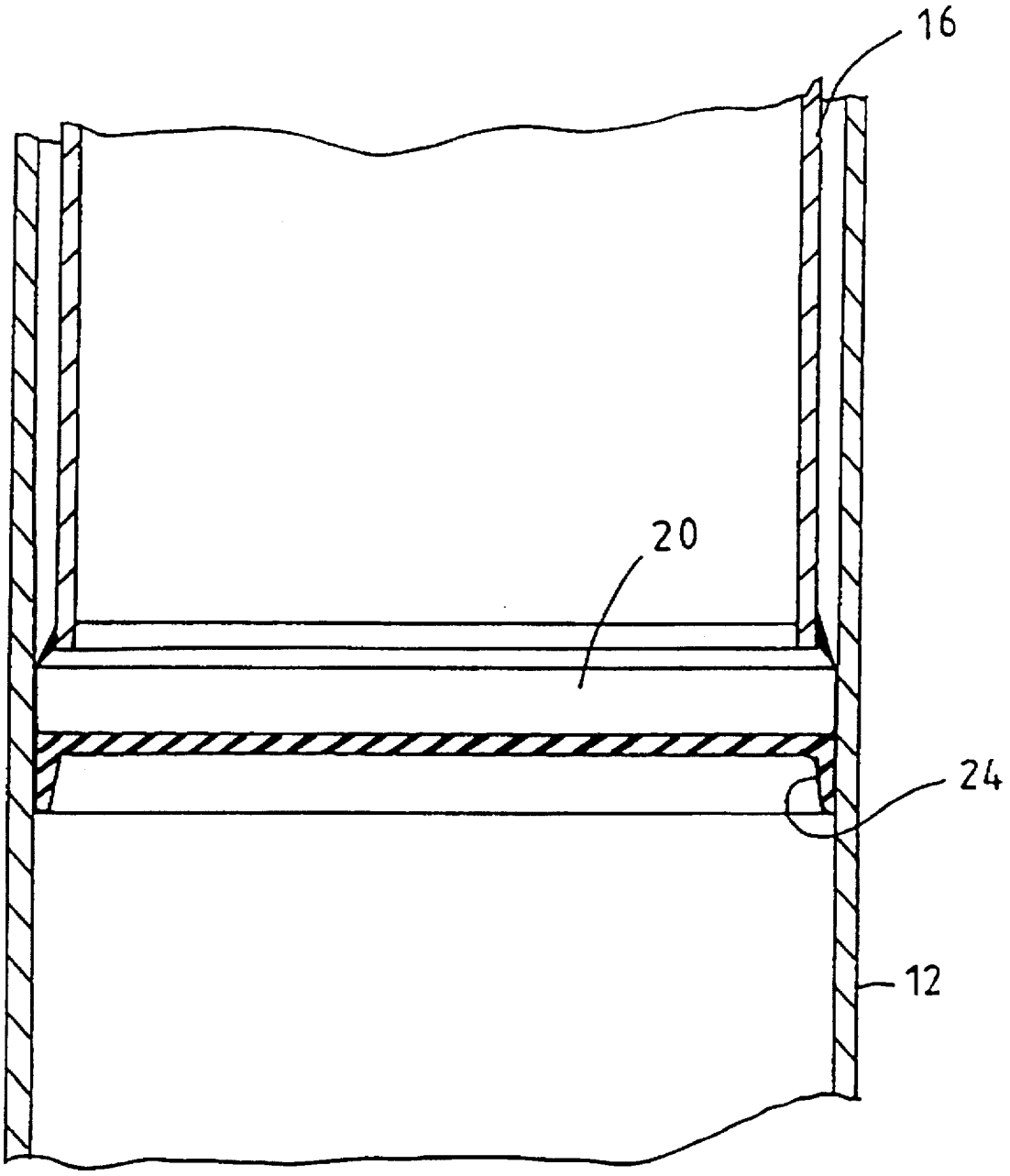
FIG. 10 is an enlarged cross-sectional side view of part of the prop.

Referring now to FIGS. 8 to 10, the end cap 20 has a planar lower surface 62, an upper surface with a circular recess 64 and a circular cylindrical bearing portion 66. A continuous, upwardly extending lip 68 on the end cap 20 locates within the bore of the plunger 16. The plunger 16 seats on a flat face 70. A 45° chamfered surface 72 is provided to facilitate tack welding the end cap 20 to the plunger 16.

The length of the circular cylindrical bearing portion 66 depends on the diameter of the bore of an outer tube 12 of the prop 10. Generally for bore diameters varying between 127 mm and 219 mm, the length of the bearing portion 66 varies between 10 mm and 20 mm. As can be seen from FIG. 10, the bearing portion 66 bears against the bore of the outer tube 12 and thus axially aligns the plunger 16 and the outer tube 12 to limit eccentric loading of the prop 10 thereby to reduce the probability of the prop failing due to buckling.

Figure 11:
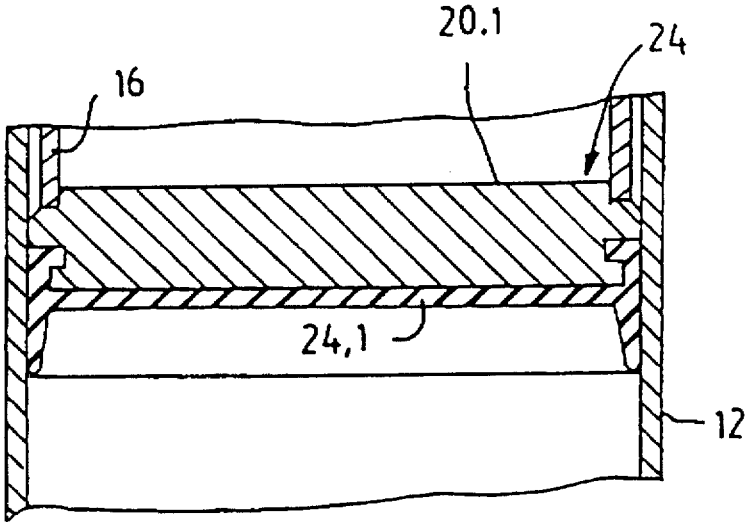
FIG. 11 is an alternative embodiment to that shown in FIG. 10.
Figure 12:
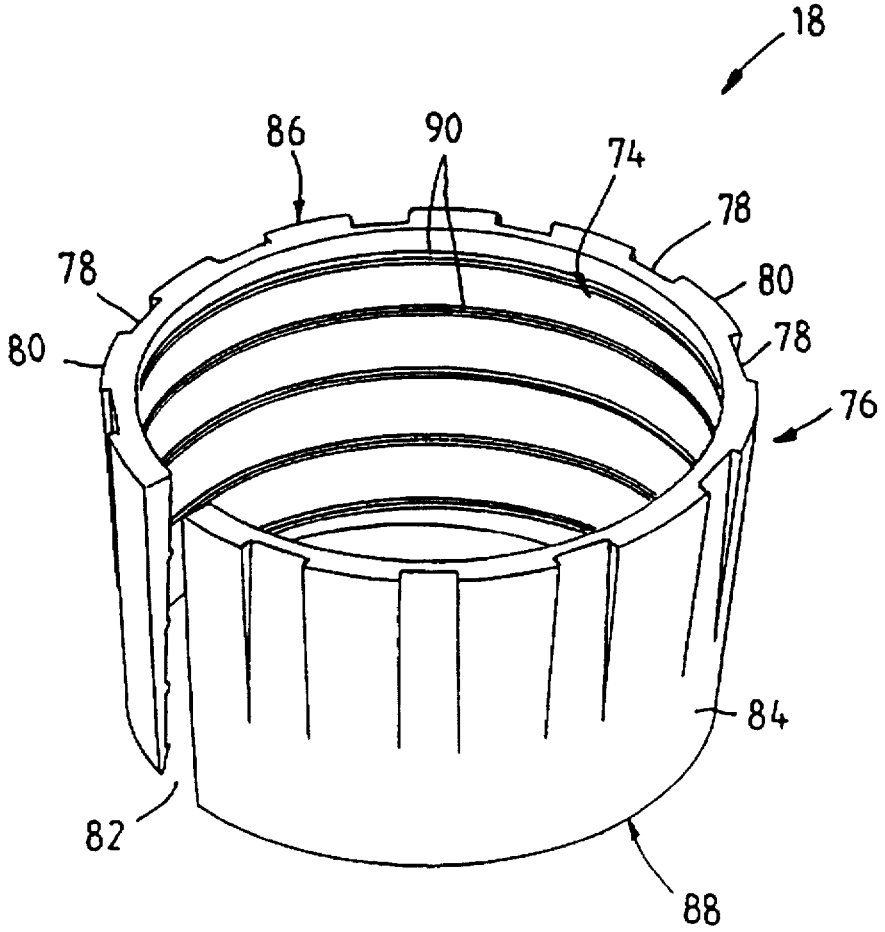
FIG. 12 is a perspective view of a deforming ring.
Figure 14:
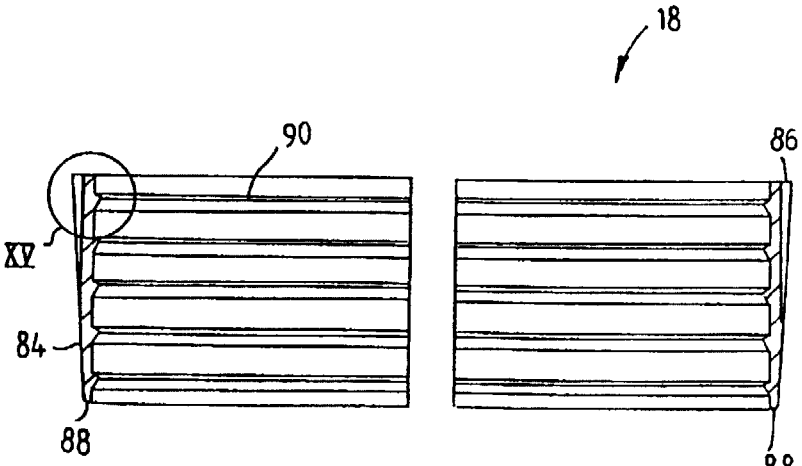
FIG. 14 is a cross-sectional side view on line XIV—XIV of FIG. 13.
Figure 15:
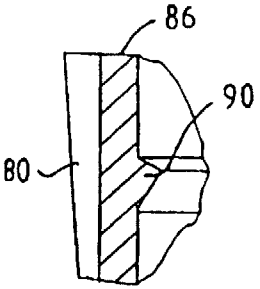
FIG. 15 is an enlarged view of the portion 16 circled and marked XV in FIG. 14.
Figure 13:
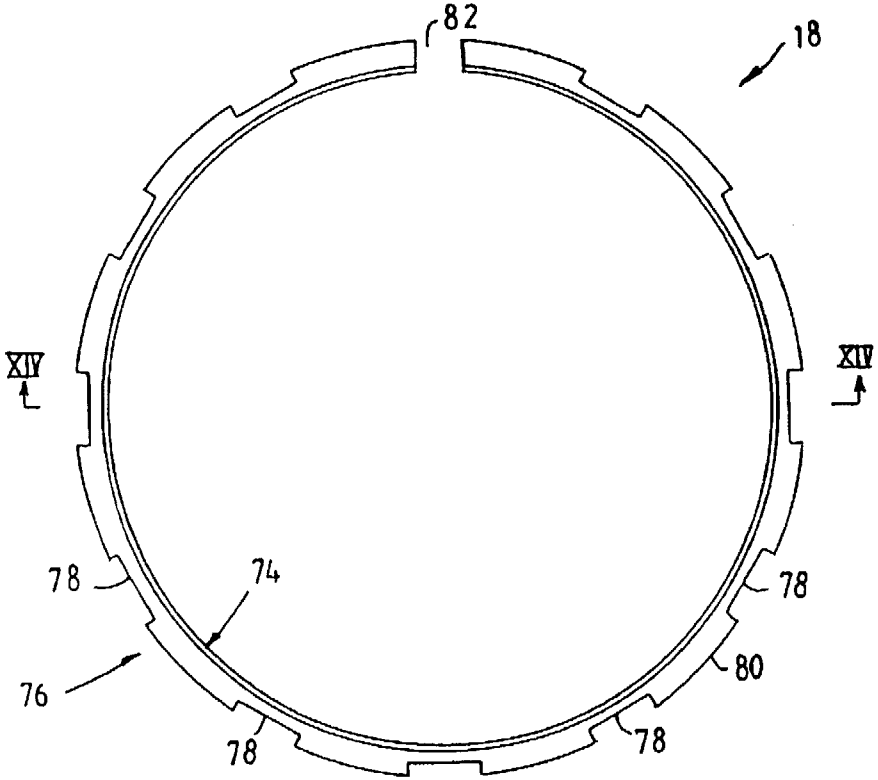
FIG. 13 is a plan view of the deforming ring.

FIG. 11 illustrates an alternative end cap 20.1 and cup seal 24.1. The cup seal 24.1 is not a floating cup seal since it is attached to the end cap 20.1.

The flared skin 60 of the cup seal 24 allows for varying tolerances and surface finishes of the bore of the outer tube 12 so that the plunger 16 can telescope relatively easily within the outer tube 12. An additional advantage of the cup seal 24 is that the same sized seal can be used where the outer diameter of the outer tube 12 is constant but where the wall thickness of the outer tube 12 is different. For example, the wall thickness of the outer tube 12 may vary between 4 mm and 6 mm depending on the load the prop is designed to carry, although the outer diameter of the outer tube 12 is constant. In such a case, a seal of one size could be used for the props because the flared skin 60 allows for the different internal diameters. It will be appreciated that the seal will be able, within reason, to tolerate widely varying surfaces finishes on the bore of the outer tube. The outer tube may for example be standard electric resistance welded tubing.

In an alternative arrangement, a suitable seal such as a O-ring may be provided on the end cap 20 or on the leading end of the plunger 16. In such a case, if a suitable aperture is provided through the end cap 20, the entire interior of the prop may be placed under hydraulic pressure to pre-load the prop.

Referring now to FIGS. 12 to 15, a cast or machined steel deforming ring 18 has an inner surface 74 and an outer surface 76. The outer surface 76 has circumferentially spaced recesses 78 with tapered outer tube contact zones 80 located between the recesses 78. A gap or split 82 is provided in the deforming ring 18.

A continuous, common tube contact zone 84 is located below the bottom of the recesses 78. The tube contact zones 80 taper from the top 86 of the deforming ring. The common tube contact zone 84 is also tapered and its taper is simply a continuation of the taper on the tube contact zones 80. The bottom 88 of the deforming ring 18 is radiused to prevent the deforming ring from digging into the outer tube 12 as the prop 10 yields.

Five axially spaced gripping formations 90 project inwardly from the inner surface 74 of the deforming ring 18. The gripping formations 90 are harder than the plunger 16 of the prop 10 so that the gripping formations 90 can dig or bite into the outer surface of the plunger 16 to engage the plunger. In the case where plunger 16 is made of mild steel, the applicant has found that heat treating the deforming ring 18 to obtain a Rockwell C hardness of 55 is sufficient to ensure that the gripping formations 90 will dig into the plunger 16.

Figure 16:
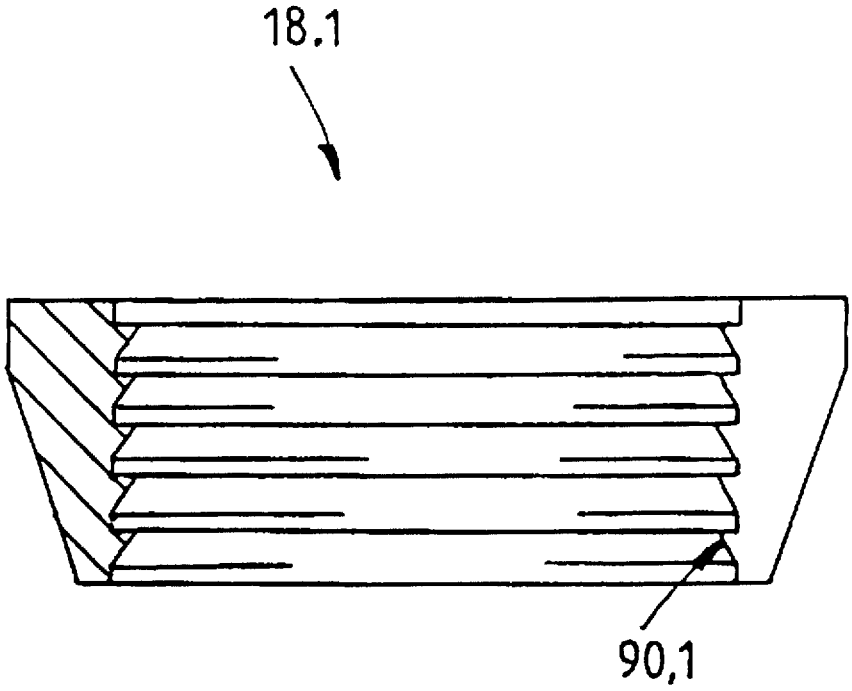
FIGS. 16 and 17 are cross-sectional side views of alternative embodiments of the deforming ring.
Figure 17:
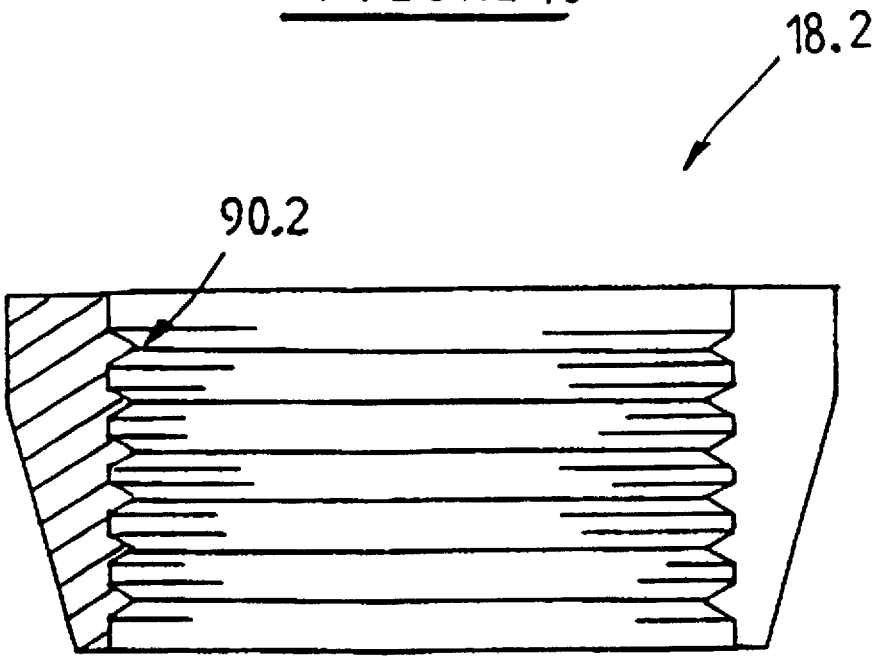

FIG. 16 and 17 illustrate alternative embodiments of the deforming ring 18. The deforming ring 18.1 in figure 16 has gripping formations 90.1 whereas the deforming ring 18.2 has gripping formations 90.2 which have a right-angled triangular cross-section.

The bore of the outer tube 12 is coated with a layer of oil. The bore may be coated with any other suitable lubricant such as grease or the like. The oil ensures that there is a substantially constant coefficient of friction between the deforming ring 18 and the bore of the outer tube 12 as the deforming ring 18 moves downwardly within the outer tube 12. A substantially constant coefficient of friction ensures that the prop will yield at a substantially predictable load and that it will then yield substantially constantly.

The prop 10 is preloaded by introducing water under pressure into the chamber 26 via the inlet 28. Sufficient hydraulic pressure is applied to provide the required preloading of the prop 10. Generally the hydraulic pressure will be between 3 MPa and 15 MPa. The preload or force exerted by the prop under the influence of the hydraulic pressure is dependent on the diameter of the bore of the outer tube 12. Whilst the hydraulic pressure is being applied, the deforming ring 18 is forced into the flared mouth 14 of the outer tube 12. This may be done by means of hammering against the deforming ring 18 with a suitable tool (not shown), until the deforming ring 18 engages the plunger 16 via the gripping formations 90. The hydraulic pressure is then released and the water within the chamber 26 is simply allowed to drain out through the inlet 28.

It will be appreciated that if the flow rate of the water entering the chamber 26 is sufficient, the seal 24 could be omitted. In such a case the prop could still be preloaded provided more water is introduced into the chamber than escapes between the plunger 16 and the bore of the outer-tube 12.

As the hanging wall 92 moves closer to the foot wall 94, so the plunger 16 and the deforming ring 18 move downwardly within the outer tube 12 as the deforming ring 18 deforms the outer tube 12 outwardly.

Figure 18:
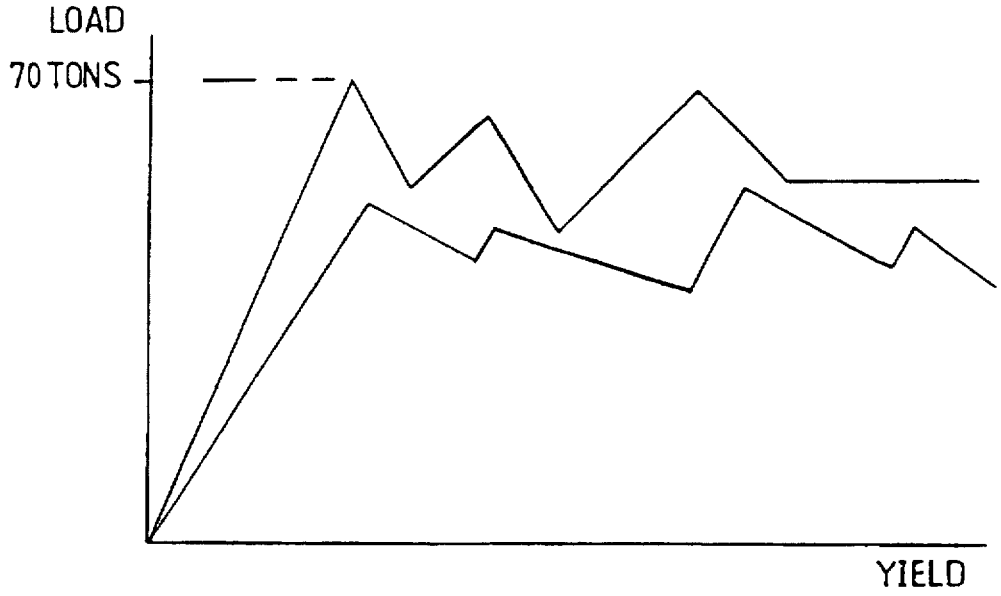
FIGURE 18 (PRIOR ART)
FIG. 18 depicts graphs of the load/yield characteristics of two prior art yieldable props.
Figure 19:
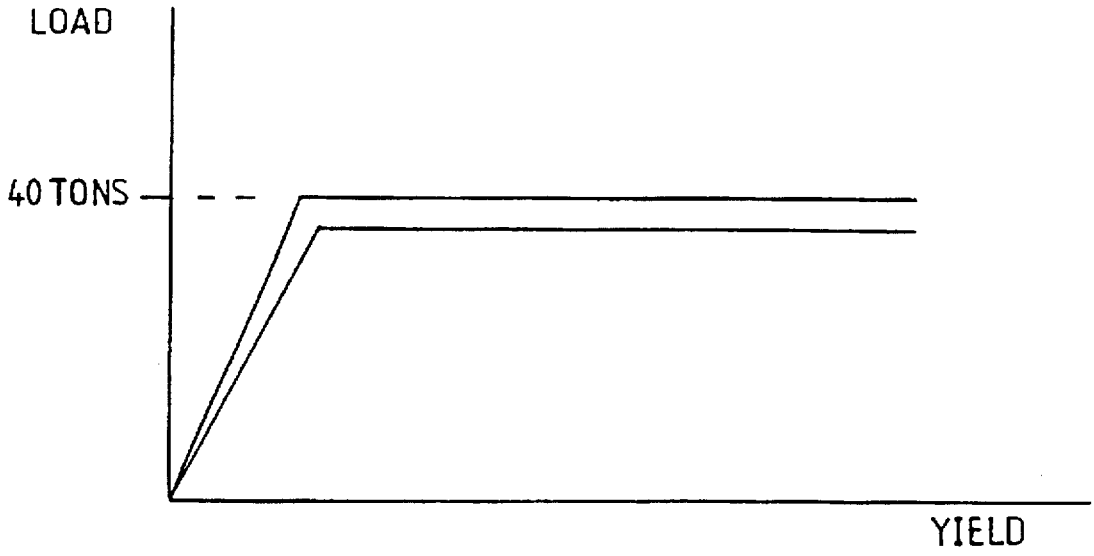
FIG. 19 depicts graphs of the load/yield characteristics of two yieldable props according to the invention.

Referring now to FIGS. 18 and 19, the graphs of the two figures are produced by four props which were identical in all respects except that the bores of the outer steel tubes which produced the graphs of FIG. 19 were lubricated, whereas the bores of the outer steel tubes which produced the graphs of FIG. 18 were not lubricated. From the two graphs of FIG. 18, it can be seen that the yield points and the load bearing characteristics of the two identical unlubricated props vary over a relatively wide range. However from the two graphs of FIG. 19, it can be seen that the yield points and the load bearing characteristics of the two identical lubricated props are very similar. Thus the yield points and load bearing characteristics of the lubricated props according to the invention can be predicted with a reasonable degree of accuracy.

It will be appreciated that many modifications or variations of the invention are possible without departing from the spirit or scope of the invention.

We claim:

1. A support prop including:

an outer tube with an open flared mouth;

a plunger which is telescopically movable in and out of the outer tube;

deforming means in the flared mouth (14) of the outer tube about the plunger which is adapted to permit axial sliding movement of the plunger relative to the outer tube and to grip and be pressed with the plunger into the outer tube under load to cause lateral outward deformation of the outer tube by which the load on the prop is yieldably resisted;

characterized in that:

the prop includes friction reducing means on the inner wall of the outer tube; a chamber in the outer tube;

an inlet for introducing fluid under pressure in the chamber to cause sliding movement of the plunger axially relative to the tube; and a seal arrangement in the chamber to limit fluid escape from the chamber.

2. The support prop of claim 1 characterised in that the seal arrangement includes a floating cup seal.

3. The support prop of claim 1 characterised in that the plunger is a tube and includes an end cap which is secured to the end of the plunge within the outer tube.

4. The support prop of claim 1 characterised in that the plunger includes a bearing portion which bears against the bore of the outer tube to locate the plunger within the outer tube to limit axial misalignment of the plunger relative to the outer tube.

5. The support prop of claim 1 characterised in that the deforming means is an inverted frusto-conical annulus which includes gripping formations on its radially inner surface for gripping the plunger once the prop has been located between the two surfaces.

6. The support prop of claim 5 characterised in that the gripping formations are harder than the plunger so that the gripping formations can bite into the plunger to grip the plunger.

7. The support prop of claim 5 characterised in that the deforming means has spaced outer tube contact zones.

8. The support prop of claim 7 characterised in that the outer tube contact zones taper from their upper ends towards their lower ends.

9. The support prop of claim 5 characterised in that the bottom end of the deforming means is radiused.

10. The support prop of claim 1 characterised in that the outer surface of the deforming means coated with friction reducing means.

11. The support prop of claim 10 characterised in that the friction reducing means comprises any one of oil, polytetrafluoroethylene, molybdenum disulphid or graphite.

12. The support prop of claim 1 characterised in that a pedestal is provided inside the outer tube on which pedestal the plunger can seat when the plunger is fully retracted into the outer tube.

13. The support prop of claim 1 characterised in that the prop includes an aperture in the sidewall of the outer tube through which aperture fluid can escape from the chamber if the plunger is displaced beyond the aperture (38) in the direction of the flared mouth of the outer tube.

14. The support prop of claim 1 characterised in that the prop includes at least one marking on the outer surface of the plunger to indicate over-extension or impending over-extension of the plunger.

15. A method of yieldably supporting a load over a surface by means of a support prop having:

an outer tube with an open flared mouth; and a plunger which is telescopically movable in and out of the outer tube through its flared mouth;

characterized in that the method includes the steps of:

introducing fluid under pressure into a chamber within the support prop to locate the prop between the load and surface by axially displacing the plunger outwardly from the outer tube forcing deforming means into the flared mouth of the outer tube to engage the plunger and set the yield load of the prop whilst the fluid is under pressure within the chamber; and allowing the fluid to drain from the chamber to enable the load across the prop to press the plunger and deforming means into the outer tube to cause the deforming means to deform the outer tube laterally outwardly yieldably to resist the load on the prop.

16. The support prop of claim 11, wherein the friction reducing means comprises anyone of oil, polytetrafluoroethylene, molybdenum disulphide or graphite.

* * * * *

UNITED STATES PATENT AND TRADEMARK OFFICE

CERTIFICATE OF CORRECTION

PATENT NO. : 5,720,581

DATED : Feb. 24, 1998

INVENTOR(S) : Michael S. Bacou, et al

It is certified that error appears in the above-indentified patent and that said Letters Patent is hereby corrected as shown below:

In the Abstract, line 1, delete "robe", insert --tube--

Col. 1, line 47, delete "robe", insert --tube--

Col. 2, line 8, delete "pan", insert --part--

Col. 4, line 59, delete "skin", insert --skirt--

Col. 5, line 3, delete "skin", insert --skirt--

Col. 7, line 9, delete "means coated", insert --means is coated--

Signed and Sealed this

Sixth Day of October, 1998

*Attest:*

*Attesting Officer*

BRUCE LEHMAN

*Commissioner of Patents and Trademarks*